US006227110B1

(12) United States Patent
Zlatin

(10) Patent No.: US 6,227,110 B1
(45) Date of Patent: May 8, 2001

(54) WET PRINTING PRESS WITH THROW-OFF MECHANISM

(75) Inventor: Lev Zlatin, Rochester, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/103,710

(22) Filed: Jun. 23, 1998

(51) Int. Cl.[7] ..... B41F 13/24
(52) U.S. Cl. ..... 101/218; 101/143; 101/247
(58) Field of Search ..... 101/216, 217, 101/218, 147, 148, 247, 248, 191, 192, 152, 153, 136, 138, 139, 140, 141, 143, 144, 145

(56) References Cited

U.S. PATENT DOCUMENTS

| | | | | |
|---|---|---|---|---|
| 4,696,229 | | 9/1987 | Bezler et al. | 101/177 |
| 4,934,265 | | 6/1990 | Knauer | 101/177 |
| 5,063,844 | * | 11/1991 | Fausel | 101/247 |
| 5,301,609 | * | 4/1994 | Guaraldi et al. | 101/216 |
| 5,806,427 | * | 9/1998 | Niemiro et al. | 101/247 |
| 5,901,648 | * | 5/1999 | Roland et al. | 101/247 |
| 6,050,185 | * | 4/2000 | Richards | 101/220 |

FOREIGN PATENT DOCUMENTS

| | | |
|---|---|---|
| 2216514 | 10/1973 | (DE) . |
| 2 309 668 | 6/1997 | (GB) . |

* cited by examiner

*Primary Examiner*—Stephen R. Funk
(74) *Attorney, Agent, or Firm*—Kenyon & Kenyon

(57) ABSTRACT

An offset printing press for printing a web, the press comprising a frame, a first plate cylinder movably mounted in the frame, and a first blanket cylinder in selective contact with the first plate cylinder. A second blanket cylinder for forming a nip with the first blanket cylinder is in contact with a second plate cylinder. The press has a first operative condition wherein the first plate cylinder and the first blanket cylinder are in direct contact to permit double-sided printing on the web, and a second operative condition wherein the first plate cylinder and the first blanket cylinder are separated to permit a plate change on the first plate cylinder while the web is printed by the second blanket cylinder.

9 Claims, 3 Drawing Sheets

WET PRINTING PRESS WITH THROW-OFF MECHANISM

FIELD OF THE INVENTION

The present invention relates to printing presses and more specifically to web-fed printing presses.

RELATED TECHNOLOGY

Certain web offset printing presses have a continuous paper web which may be printed on both sides. Typical offset web presses permitting double-sided printing do not permit for printing on one side of the web while a printing plate on the other side of the web is changed.

SUMMARY OF THE INVENTION

The present invention provides an offset printing press for printing a web, the press comprising a frame, a first plate cylinder moveably mounted in the frame and a first blanket cylinder in selective contact with the first plate cylinder. A second blanket cylinder is provided for forming a nip with the first blanket cylinder, the web being able to pass through the nip. A second plate cylinder contacts the second blanket cylinder and also may be moveably mounted in the frame. The press has a first operative condition wherein the first plate cylinder and the first blanket cylinder are in direct contact to permit double-sided printing on the web, a second operative condition wherein the first plate cylinder and the first blanket cylinder are separated to permit a plate change on the first plate cylinder while the web is printed by the second blanket cylinder, and may have a third operative condition wherein the second plate cylinder and the second blanket cylinder are separated while the web is printed by the first blanket cylinder.

The present invention thus advantageously provides an arrangement wherein plate changes may be performed while the web is still being printed on one side. This can reduce downtime and improve productivity of the press.

Advantageously, one of the blanket cylinders also may be movably mounted. In addition, the movably mounted cylinders advantageously can be pivotally mounted in the frame for simple and stable translational movement.

BRIEF DESCRIPTION OF THE DRAWINGS

In the following, the present invention is explained in more detail with the aid of the drawings, in which.

DETAILED DESCRIPTION

Figure 1:
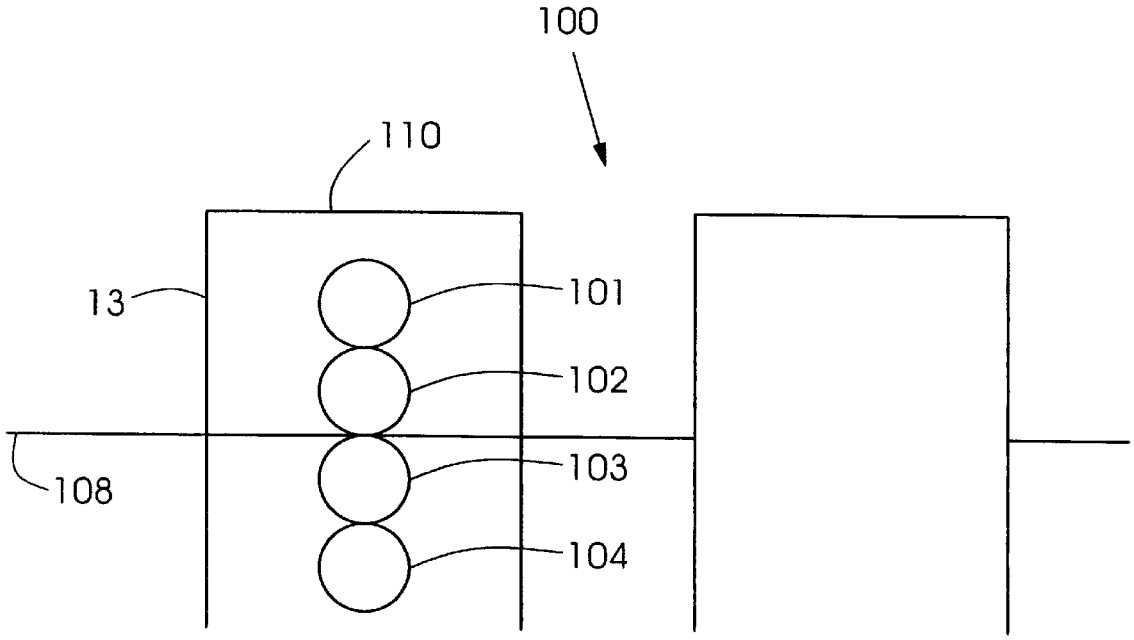
FIG. 1 shows a general view of an offset web printing press of the present invention.

FIG. 1 shows a side view of an offset web printing press 100 having at least one print unit 110 with a frame 13, a first plate cylinder 101, a first blanket cylinder 102, a second blanket cylinder 103 and a second plate cylinder 104. A web 108 of paper passes through a nip formed between the first blanket cylinder and second blanket cylinder. For color printing it is understood that the printing press 100 would have a plurality, typically, four, of such print units.

The printing press 100 has three operative conditions: a first operative condition in which the web 108 is printed on both sides; a second operative condition in which the second plate cylinder 104 prints on one side of the web 108 through the second blanket cylinder 103 while the first plate cylinder 101 is disengaged from the first blanket cylinder 102; and a third operative condition in which the first plate cylinder 101 prints on an other side of the web 108 through the first blanket cylinder 102 while the second plate cylinder 104 is disengaged from the second blanket cylinder 103. Thus in the second operative condition a printing plate on the first plate cylinder 101 can be changed while printing continues on one side of the web 108, and in the third operative condition a printing plate on the second plate cylinder 104 can be changed while printing occurs on the other side. These operative conditions can be simultaneous for each print unit of the printing press 100.

Figure 2:
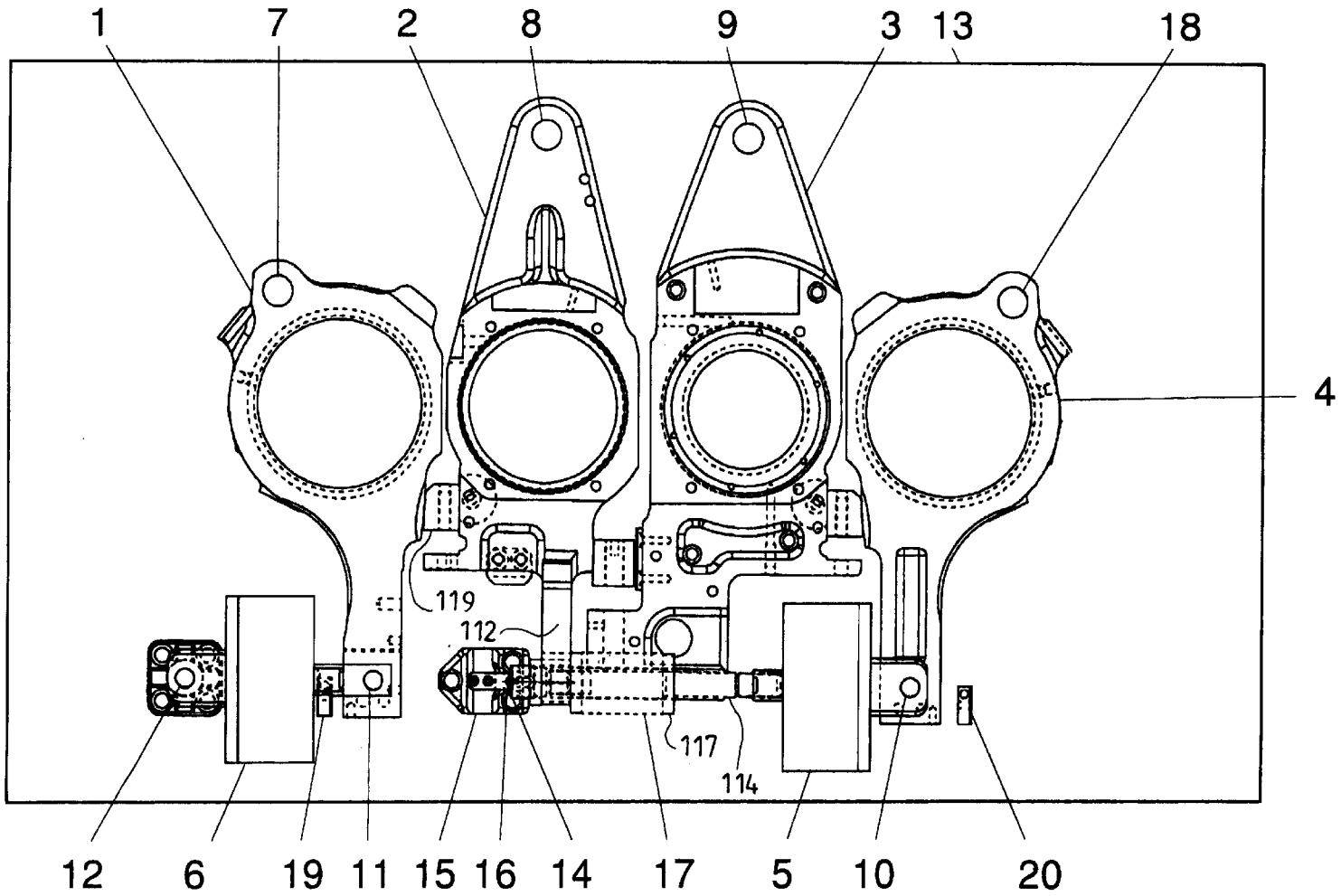
FIG. 2 shows a detailed side view of one embodiment of the printing press of the present invention.

FIG. 2 shows one embodiment of the printing press of the present invention in more detail. The plate cylinder 101, the blanket cylinder 102, the blanket cylinder 103 and the plate cylinder 104 of FIG. 1 each have an end disposed in a first plate cylinder box 1, a first blanket cylinder box 2, a second blanket cylinder box 3, and a second plate cylinder box 4, respectively. Each of the cylinder boxes 1, 2 and 4 are movably mounted in the frame 13 through pivots 7, 8, and 18, respectively. The second blanket cylinder box 3 is however fixedly mounted to the frame 13 by bolts, including bolt 9. It should be understood that on the other side of the cylinders 101, 102, and 104, corresponding boxes (not shown) are mounted pivotally to support the other ends of the cylinders, while the other side of second blanket cylinder 103 has a corresponding second blanket cylinder box fixedly mounted to frame 13.

To provide the three operative conditions, two air cylinders 5 and 6 may be provided. A first air cylinder 5 is connected at one side through a pivot 10 to the second plate cylinder box 4, and at another side through a rod 114 to the frame 13. The rod 114 has a rod end 14 mounted to a block 15 attached to the frame 13. The rod end 14 has a slot which interacts with a pin 16 of the block 15. The rod 114 passes through a hole in an arm 112 of the first blanket cylinder box 2. A spring 17 interacts between a stop 117 fixed to the rod 114 and the arm 112 to force the arm away from the stop 117. A second air cylinder 6 is attached at one end to the first plate cylinder box 1 through a pivot 11 and at the other end to a pivot 12 in the frame 13.

In the first operative condition when both sides of the web are being printed, the air cylinder 6 forces the plate cylinder box 1 against a stop 119 on the blanket cylinder box 2 so that the plate cylinder 101 is in contact with the blanket cylinder 102. The air cylinder 5 pulls the second plate cylinder box 4 to the fixed second blanket cylinder box 3 and the rod end 14 pulls the first blanket cylinder box 2 through arm 112 and against the action of spring 17 to the second blanket cylinder box 3. All of the cylinders 101, 102, 103 and 104 are thus in contact and double sided printing can occur on the web 108 passing through the nip formed by the blanket cylinders 102 and 103.

In the second operative condition, the second air cylinder 6 pulls the first plate cylinder box 1 so that the cylinder box 1 rotates about pivot 7 until the box 1 comes against a stop 19. The plate cylinder 101 is thus no longer in contact with the blanket cylinder 102, and a plate change can occur on the first plate cylinder 101, even while printing by second plate cylinder 104 continues.

In the third operative condition, the second air cylinder 6 again pushes the first plate cylinder box 1 against the stop 119 so that the first plate cylinder 101 contacts the first blanket cylinder 102. The first air cylinder 5 operates so that the rod end 14 pushes against the block 15 and simultaneously the second plate cylinder box 4 is pivoted about pivot 18 until blocked by a stop 20. Since the second blanket cylinder box 3 is fixed to the frame 13, the second plate cylinder 104 is thus separated from the second blanket cylinder 103 and a plate change may occur, even while printing by the first plate cylinder 101 occurs on another side of the web 108.

In a non-operative or non-printing condition, the first and second air cylinders 5, 6 operate so that the first plate cylinder box 1 is forced against stop 19 and the second plate cylinder box 4 is forced against stop 20. The spring 17 then forces the first blanket cylinder box 2 to rotate about pivot 8 away from the second blanket cylinder box 3 until arm 112 contacts block 15. In this way the two blanket cylinders 102 and 103 may be separated.

Figure 3:
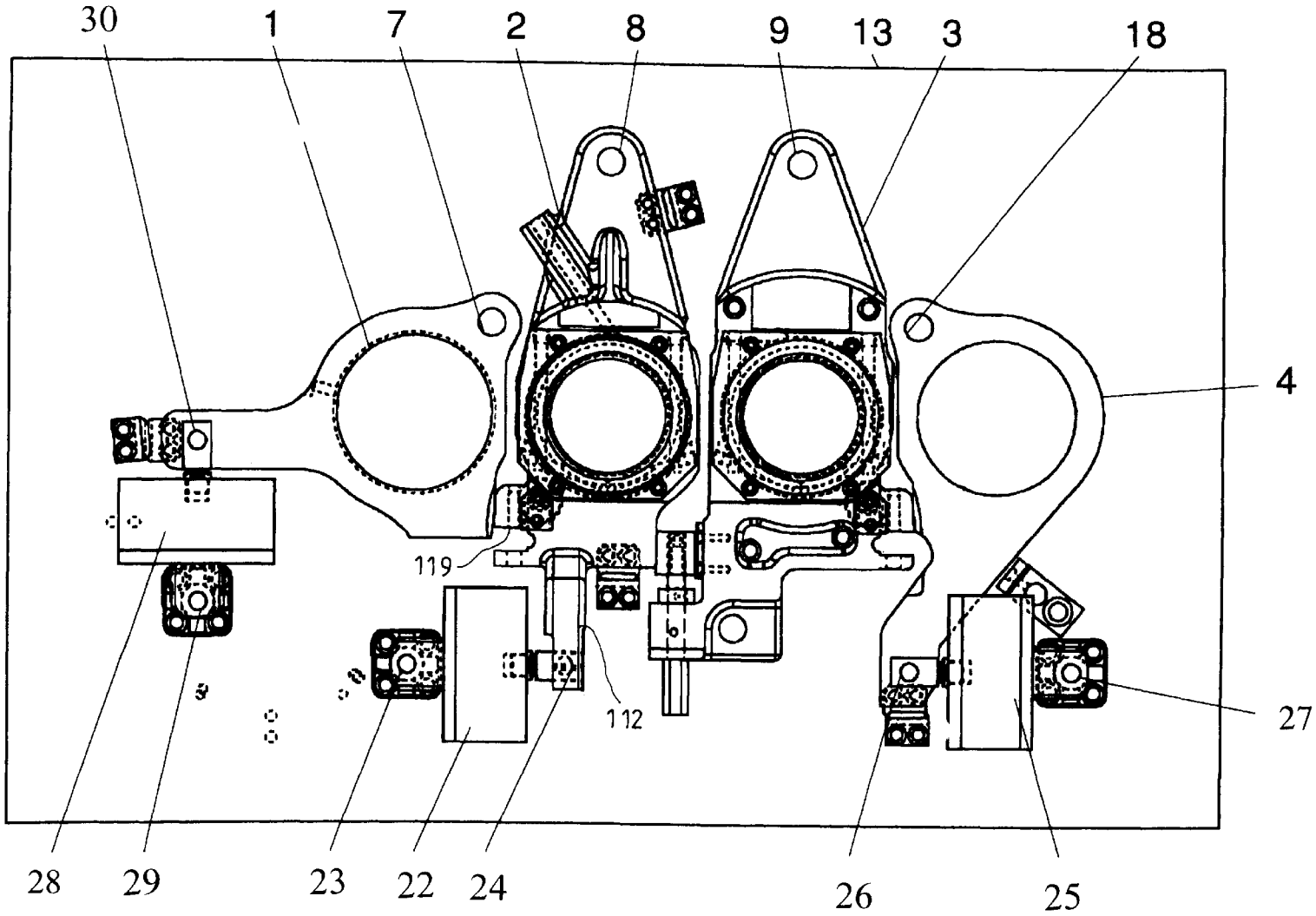
FIG. 3 shows a detailed side view of a second embodiment of the printing press of the present invention.

FIG. 3 shows a second embodiment of the present invention in which three air cylinders 22, 25 and 28 are used to provide the three operative conditions. The second plate cylinder box 3 again is fixed, while the other cylinder boxes 1, 2 and 4 are pivotally mounted to the frame by pivots 7, 8 and 18, respectively.

In the first operative condition the first air cylinder 22, connected at one side to a pivot 23 and at the other side to a pivot 24 connected to an arm 112 of the cylinder box 2, forces the cylinder box 2 against the cylinder box 3. The second air cylinder 25, connected at one end to the cylinder box 4 through pivot 26 and at the other end to a pivot 27 connected to the frame 13, forces the cylinder box 4 against the cylinder box 3. The third air cylinder 28 is connected to the frame 13 through pivot 29 and to the first plate cylinder box 1 through the pivot 30. The third air cylinder 28 pulls the cylinder box 1 against a stop 119 in the first operative condition.

In the second operative condition, the third air cylinder 28 pushes the first plate cylinder box 1 away from the stop 119 so that a plate on the first plate cylinder 101 can be changed.

In the third operative condition, the third air cylinder 28 pulls the cylinder box 1 against the stop 119 while the second air cylinder 25 pulls the cylinder box 4 away from the cylinder box 3.

In a non-printing or non-operative condition, the third air cylinder 28 pushes the first plate cylinder box 1 away from the pivot 29 and the first air cylinder 22 pulls the first blanket cylinder box 2 away from the second blanket cylinder box 3.

"Movably mounted" as herein defined means being mounted so as to be translationally movable, and includes being pivotally mounted.

What is claimed is:

1. An offset printing press for printing a web, the press comprising:

a frame;

a first plate cylinder pivotally mounted in the frame;

a first blanket cylinder movably mounted in the frame, the first blanket cylinder in selective contact with the first plate cylinder;

a second blanket cylinder rotatably mounted and translationally fixed to the frame for forming a nip with the first blanket cylinder, the web being able to pass through the nip; and a second plate cylinder pivotally mounted to the frame for contacting the second blanket cylinder;

a first air cylinder connected to the first blanket cylinder and the second plate cylinder;

a second air cylinder connected to the first plate cylinder;

the press having a first operative condition wherein the first plate cylinder and the first blanket cylinder are in direct contact to permit double-sided printing on the web;

a second operative condition wherein the first plate cylinder and the first blanket cylinder are separated to permit a plate change on the first plate cylinder while the web is printed by the second blanket cylinder;

third operative condition wherein the second plate cylinder and the second blanket cylinder are separated while the web is printed by the first blanket cylinder and a non-printing condition in which the first blanket cylinder is separated from the second blanket cylinder.

2. The offset printing press as recited in claim 1 further comprising a first plate cylinder box, the second air cylinder being connected to the first plate cylinder through the first plate cylinder box.

3. The offset printing press as recited in claim 1 further comprising a first plate cylinder box, a first blanket cylinder box, and a second plate cylinder box, the first air cylinder being connected to the first blanket cylinder through the first blanket cylinder box and to the second plate cylinder through the second plate cylinder box, and the second air cylinder being connected to the first plate cylinder through the first plate cylinder box.

4. An offset printing press for printing a web, the press comprising:

a frame;

a first plate cylinder movably mounted in the frame;

a first blanket cylinder in selective contact with the first plate cylinder and being pivotally mounted in the frame;

a first air cylinder connected to the first blanket cylinder and the second plate cylinder;

a second blanket cylinder for forming a nip with the first blanket cylinder, the web being able to pass through the nip; and a second plate cylinder for contacting the second blanket cylinder and being moveably mounted in the frame, the press having a first operative condition wherein the first plate cylinder and the first blanket cylinder are in direct contact to permit double-sided printing on the web;

a second operative condition wherein the first plate cylinder and the first blanket cylinder are separated to permit a plate change on the first plate cylinder while the web is printed by the second blanket cylinder; and a third operative condition wherein the second plate cylinder and the second blanket cylinder are separated while the web is printed by the first blanket cylinder.

5. The offset printing press as recited in claim 4 wherein the first plate cylinder is pivotally mounted to the frame.

6. The offset printing press as recited in claim 4 wherein the second plate cylinder is pivotally mounted in the frame.

7. The offset printing press as recited in claim 4 wherein the second blanket cylinder is rotatably mounted but translationally fixed in the frame.

8. The offset printing press as recited in claim 4 further comprising and a second air cylinder connected to the frame and the first plate cylinder.

9. The offset printing press as recited in claim 8 wherein the first air cylinder is connected to the first blanket cylinder through a spring.

* * * * *